US012757945B2

(12) United States Patent
Besso et al.

(10) Patent No.: US 12,757,945 B2
(45) Date of Patent: Oct. 13, 2026

(54) HEAT DISTRIBUTION IN AEROSOL-GENERATING DEVICE

(71) Applicant: PHILIP MORRIS PRODUCTS S.A., Neuchatel (CH)

(72) Inventors: Clement Besso, Neuchatel (CH); Robert Emmett, Ingatestone (GB); Houxue Huang, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 444 days.

(21) Appl. No.: 18/286,055

(22) PCT Filed: Apr. 8, 2022

(86) PCT No.: PCT/EP2022/059484

§ 371 (c)(1),
(2) Date: Oct. 6, 2023

(87) PCT Pub. No.: WO2022/214675

PCT Pub. Date: Oct. 13, 2022

(65) Prior Publication Data

US 2024/0114975 A1 Apr. 11, 2024

(30) Foreign Application Priority Data

Apr. 9, 2021 (EP) ..... 21167592

(51) Int. Cl.
*A24F 42/60* (2020.01)

(52) U.S. Cl.
CPC ..... *A24F 42/60* (2020.01)

(58) Field of Classification Search
CPC ..... A24F 42/60; A24F 47/00
(Continued)

(56) References Cited

U.S. PATENT DOCUMENTS 3,360,965 A 1/1968 Spreter
3,665,770 A 5/1972 Sagi
(Continued)

FOREIGN PATENT DOCUMENTS

DE 202015009586 6/2018
EP 0857431 8/1998
(Continued)

OTHER PUBLICATIONS

PCT International Search Report and Written Opinion for PCT/EP2022/059484 dated Jul. 21, 2022 (13 pages).
(Continued)

*Primary Examiner* — Christopher M Rodd
*Assistant Examiner* — Ronnie Kirby Jordan
(74) *Attorney, Agent, or Firm* — Mueting Raasch Group

(57) ABSTRACT

An aerosol-generating device (3) comprises an axially extending heating space (21). The heating space (21) is configured to at least partially receive an aerosol-generating article (5). The aerosol-generating device (3) comprises a heat receiving surface (25) provided outside of the heating space (21). The aerosol-generating device (3) comprises a heat storage body (31) and an inner heat conduction body (33). The heat storage body (31) is provided between the heat receiving surface (25) and the heating space (21). The inner heat conduction body (33) is provided between the heat storage body (31) and the heating space (21). A material of the heat storage body (31) has a higher specific heat capacity than a material of the inner heat conduction body (33). The material of the inner heat conduction body (33) has a higher thermal conductivity than the material of the heat storage body (31).

15 Claims, 3 Drawing Sheets

(58) Field of Classification Search
USPC ..... 131/329
See application file for complete search history.

(56) References Cited

U.S. PATENT DOCUMENTS

| | | | | |
|---|---|---|---|---|
| 6,089,857 | A * | 7/2000 | Matsuura et al. | A61M 15/06 131/329 |
| 6,125,853 | A | 10/2000 | Susa | |
| 10,010,112 | B2 | 7/2018 | Silvestrini | |
| 10,194,691 | B2 | 2/2019 | Sebastian | |
| 10,206,425 | B2 | 2/2019 | Breiwa, III | |
| 2012/0312822 | A1 | 12/2012 | Cheng | |
| 2013/0014755 | A1 | 1/2013 | Kumar | |
| 2014/0186015 | A1 | 7/2014 | Breiwa, III | |

FOREIGN PATENT DOCUMENTS

| | | |
|---|---|---|
| EP | 0858744 | 8/1998 |
| EP | 2910135 | 8/2015 |
| FR | 1455197 | 4/1966 |
| JP | 97/048295 | 12/1997 |
| JP | 1998-004946 | 1/1998 |
| JP | 2000-238865 | 9/2000 |
| WO | WO 2017/207580 | 12/2017 |
| WO | WO 2020/007800 | 1/2020 |

OTHER PUBLICATIONS

Jiao J, Grorud B, Sindland C, Safarian J, Tang K, Sellevoll K, Tangstad M. The Use of Eutectic Fe—Si—B Alloy as a Phase Change Material in Thermal Energy Storage Systems. Materials (Basel). Jul. 19, 2019;12(14):2312. doi: 10.3390/ma12142312. PMID: 31331022; PMCID: PMC6678291.

Okamoto, H. Bi-Sn (Bismuth-Tin). J. Phase Equilib. Diffus. 31, 205 (2010). https://doi.org/10.1007/s11669-010-9659-y.

Office Action issued in Japan for Application No. 2023-561870 dated Mar. 2, 2026 (4 pages). English translation included.

* cited by examiner

HEAT DISTRIBUTION IN AEROSOL-GENERATING DEVICE

This application is a U.S. National Stage Application of International Application No. PCT/EP2022/059484 filed Apr. 8, 2022, which was published in English on Oct. 13, 2022, as International Publication No. WO 2022/214675 A1. International Application No. PCT/EP2022/059484 claims priority to European Application No. 21167592.1 dated Apr. 9, 2021.

The present disclosure relates to heating an aerosol-generating article in an aerosol-generating device. The present disclosure relates to managing heat in an aerosol-generating device.

EP 0 858 744 A1 describes a flavor generation piece having a heat conduction tube in which a formed body of solid material for generating a flavor or the like to be inhaled by a user is provided. The flavor generation piece may be inserted into a flavor generation heater so that the heat conduction tube is provided above a gas nozzle for providing a flame. An inner surface of the heat conduction tube is covered with a heat accumulating material layer. The heat accumulating material layer allows a temperature of the formed body in the heat conduction tube to be maintained at a flavor generation temperature for a longer time.

According to an aspect of the present invention, there is provided an aerosol-generating device with an axially extending heating space. The heating space is configured to at least partially receive an aerosol-generating article. The aerosol-generating device comprises a heat receiving surface provided outside of the heating space. The aerosol-generating device comprises a heat storage body and an inner heat conduction body. The heat storage body is provided between the heat receiving surface and the heating space. The inner heat conduction body is provided between the heat storage body and the heating space. A material of the heat storage body has a higher specific heat capacity than a material of the inner heat conduction body. The material of the inner heat conduction body has a higher thermal conductivity than the material of the heat storage body.

The heat storage body may serve as a heat buffer. The heat storage body may take up heat from the heat receiving surface, when the heat receiving surface is heated. The heat taken up by the heat storage body may be provided to the heating space over time to heat the aerosol-generating article provided therein. The heat storage body may take up a certain amount of heat over a first time and release the amount of heat over a second, greater time. For example, the second time may be at least twenty times the first time, or at least fifteen times the first time, or at least ten times the first time, or at least five times the first time, or at least double the first time. Due to the buffer function of the heat storage body, overheating of the heating space may be prevented, when the heat receiving surface is heated to high temperatures. Further, the heat storage body may allow the heating space to maintain an aerosol generation temperature for a longer period of time after heating of the heat receiving surface has stopped.

The inner heat conduction body may facilitate transferring heat stored in the heat storage body towards the heating space, and thus towards an aerosol-generating article at least partially received in the heating space. The inner heat conduction body may distribute the heat to desired regions at the aerosol-generating article in an efficient manner. The inner heat conduction body may guide a flow of heat from the heat storage body.

The material of the heat storage body may have a specific heat capacity between 300 joule per kelvin per kilogram and 1500 joule per kelvin per kilogram, or between 500 joule per kelvin per kilogram and 1200 joule per kelvin per kilogram, or between 600 joule per kelvin per kilogram and 1000 joule per kelvin per kilogram, or between 600 joule per kelvin per kilogram and 800 joule per kelvin per kilogram.

The material of the heat storage body may, for example, be glass or metal. The material of the heat storage body may comprise glass or metal.

One or both of the material of the heat storage body and the material of the inner heat conduction body may have a melting temperature above 800 degrees Celsius, or above 900 degrees Celsius, or above 1000 degrees Celsius, or above 1100 degrees Celsius, or above 1300 degrees Celsius, or above 1500 degrees Celsius. In view of such melting temperatures, the heat storage body and the inner heat conduction body may be prevented from melting upon heating the heat receiving surface. In particular, the heat storage body and the inner heat conduction body may be prevented from melting, when the heat receiving surface is heated by one or more flames, such as a flame generated by a common cigarette lighter.

One or both of the heat storage body and the inner heat conduction body may circumferentially surround the heating space. If the heat storage body circumferentially surrounds the heating space, the heat storage body may store heat circumferentially around the heating space. If the inner heat conduction body circumferentially surrounds the heating space, heat may be distributed by the inner heat conduction body fully around the heating space. One or both of the heat storage body and the inner heat conduction body may surround the heating space over a full circumference of the heating space. One or more of the heat storage body and the inner heat conduction body may surround the heating space over at least 50 percent, or at least 60 percent, or at least 70 percent, or at least 80 percent, or at least 90 percent of a full circumference of the heating space. One or more of the heat storage body and the inner heat conduction body may surround the heating space over no more than 90 percent, or no more than 80 percent, or no more than 70 percent, or no more than 60 percent, or no more than 50 percent of a full circumference of the heating space.

The inner heat conduction body may comprise a protrusion extending into the heating space. The protrusion may be configured to immerse into the aerosol-generating article upon insertion of the aerosol-generating article into the heating space. In particular, the protrusion may be configured to immerse into an aerosol-generating section of the aerosol-generating article. The protrusion may conduct heat into the aerosol-generating article to heat the aerosol-generating article from the inside. The protrusion may facilitate homogenous heating of the aerosol-generating article. The protrusion may have the form of a pin or a blade, for example. The protrusion may be an integral part of the inner heat conduction body. The protrusion may extend into the heating space along the axial direction. The protrusion may have a length into the axial direction between 5 and 50 millimeters, or between 5 and 40 millimeters, or between 5 and 30 millimeters, or between 5 and 25 millimeters, or between 5 and 20 millimeters, or between 5 and 15 millimeters, or between 5 and 10 millimeters, or between 2 and 5 millimeters, or between 10 and 15 millimeters, or between 10 and 20 millimeters.

The inner heat conduction body may form at least a part of a wall defining the heating space. A surface of the inner heat conduction body may at least partially delimit the heating space. If there are no elements of the aerosol-generating device between the inner heat conduction body and the aerosol-generating article received within the heating space, the inner heat conduction body may efficiently provide heat to the heating space.

The inner heat conduction body may be in contact with the heat storage body. Contact between the inner heat conduction body and the heat storage body may facilitate efficient heat transfer between the heat storage body and the inner heat conduction body. The inner heat conduction body may be in contact with the heat storage body circumferentially around the heating space.

The aerosol-generating device may comprise an outer heat conduction body. The outer heat conduction body may be provided between the heat receiving surface and the heat storage body. The outer heat conduction body may facilitate transfer of heat from the heat receiving surface to the heat storage body.

A material of the outer heat conduction body may have a higher thermal conductivity than the material of the heat storage body.

The material of the heat storage body may have a higher specific heat capacity than the material of the outer heat conduction body.

The outer heat conduction body may be formed of the same material as the inner heat conduction body.

The specific heat capacity of the material of the heat storage body may be at least 300 percent, or at least 250 percent, or at least 200 percent, or at least 150 percent, or at least 130 percent, or at least 110 percent of at least one of the specific heat capacity of the material of the inner heat conduction body and the specific heat capacity of the material of the outer heat conduction body.

At least one of the thermal conductivity of the material of the inner heat conduction body and the thermal conductivity of the material of the outer heat conduction body may be at least 500 times, or at least 400 times, or at least 300 times, or at least 200 times, or at least 100 times, or at least 50 times, or at least 30 times, or at least 10 times, or at least 5 times the thermal conductivity of the material of the heat storage body. At least one of the thermal conductivity of the material of the inner heat conduction body and the thermal conductivity of the material of the outer heat conduction body may be at least 200 percent, or at least 150 percent, or at least 130 percent, or at least 110 percent of the thermal conductivity of the material of the heat storage body.

The outer heat conduction body may be in contact with the heat storage body to facilitate heat transfer between the outer heat conduction body and the heat storage body.

The heat receiving surface may be a surface of the outer heat conduction body. The heat receiving surface may be an outer surface of the outer heat conduction body with respect to the heating space. The heat receiving surface may be a radially outer surface of the outer heat conduction body. The heat receiving surface may be a surface of the outer heat conduction body that is spaced from the heating space with respect to the axial direction.

The outer heat conduction body may circumferentially surround the heating space. The outer heat conduction body may circumferentially surround the heat storage body. The outer heat conduction body may at least partially be provided radially outwards of the heat storage body. The outer heat conduction body may at least partially be provided at a side of the heat storage body that axially faces away from the heating space.

A thermal resistance for heat transport through the outer heat conduction body in a radial direction may be different at at least two different locations of the outer heat conduction body. For example, the thermal resistance for heat transport through the outer heat conduction body at a first location of the outer heat conduction body may be at least 300 percent, or at least 250 percent, or at least 200 percent, or at least 150 percent, or at least 130 percent, or at least 110 percent of the thermal resistance for heat transport through the outer heat conduction body at a second location of the outer heat conduction body. The thermal resistance for heat transport through the outer heat conduction body in a radial direction may vary along at least one of the axial direction and a circumferential direction. A non-homogenous thermal resistance for heat transport through the outer heat conduction body in a radial direction may allow directed heat transport through the outer heat conduction body.

A thickness of the outer heat conduction body may be different at at least two different locations of the outer heat conduction body. For example, the thickness of the outer heat conduction body at a first location of the outer heat conduction body may be at least 300 percent, or at least 250 percent, or at least 200 percent, or at least 150 percent, or at least 130 percent, or at least 110 percent of the thickness of the outer heat conduction body at a second location of the outer heat conduction body. A varying thickness of the outer heat conduction body may lead to different thermal resistances for heat transport through the outer heat conduction body in a radial direction. The thickness of the outer heat conduction body may vary along at least one of the axial direction and a circumferential direction. A thickness of the outer heat conduction body may be highest at the heat receiving surface. A thickness of the outer heat conduction body may decrease with the distance to the heat receiving surface along at least one of the axial direction and the circumferential direction.

One or more channels may be provided in the outer heat conduction body. The one or more channels may influence thermal resistance for heat transport through the outer heat conduction body. Heated air may flow through the one or more channels. The one or more channels may comprise one or more openings. The one or more openings may be provided at the heat receiving surface.

A thermal resistance for heat transport through the outer heat conduction body along a radial direction may be highest at the heat receiving surface. This may prevent excessive heating of the heating chamber and the aerosol-generating article provided in the heating chamber at a position that corresponds to the position of the heat receiving surface. A high thermal resistance for heat transport through the outer heat conduction body along the radial direction at the receiving surface may cause heat from the heat receiving surface to be more evenly distributed over the heating space. The thermal resistance for heat transport through the outer heat conduction body along the radial direction may increase with the distance to heat receiving surface, in particular along at least one of the axial direction and the circumferential direction.

The outer heat conduction body may comprise two or more different materials having different thermal conductivities. The two or more different materials may be arranged to provide a desired heat conduction profile. The two or more different materials may be arranged to provide a desired distribution of a thermal resistance for heat transport through the outer heat conduction body along a radial direction. The outer heat conduction body may, for example, comprise two or more layers, wherein each layer is formed of a different material. The layers may, for example, be arranged one behind the other with respect to the axial direction or with respect to a radial direction (or both the axial direction and the radial direction).

The aerosol-generating device may further comprise a heater configured to heat the heat receiving surface. The heater may, for example, comprise an electrical resistance heater, or an induction heater. The heater may be configured to generate one or more flames to heat the heat receiving surface. The heater may be configured to burn gas to generate the one or more flames. The one or more flames may comprise at least two flames. The heater may be formed integrally with a main body of the aerosol-generating device. Alternatively, the heater may be, fully or partially, provided as a separate entity. The heater may, for example, be a conventional cigarette lighter.

According to a further aspect of the present invention, there is provided an aerosol-generating system. The aerosol-generating system may comprise the aerosol-generating device and the aerosol-generating article. The aerosol-generating article may have an aerosol-generating section. The aerosol-generating section may comprise material configured to generate aerosol upon being heated. The aerosol-generating section may be at least partially received in the heating space when the aerosol-generating article is at least partially received in the heating space.

According to another aspect of the present invention, there is provided a method for generating aerosol. The method comprises heating a heat receiving surface of an aerosol-generating device. The aerosol-generating device at least partially receives an aerosol-generating article. Heat from heating the heat receiving surface is stored in a heat storage body provided between the heat receiving surface and the aerosol-generating article. Heat is distributed to the aerosol-generating article via an inner heat conduction body provided between the heat storage body and the aerosol-generating article. A material of the heat storage body has a higher specific heat capacity than a material of the inner heat conduction body.

The material of the inner heat conduction body may have a higher thermal conductivity than the material of the heat storage body.

The heat receiving surface may be heated with more than one flame at the same time. For example, the heat receiving surface may be heated with two or more than two flames at the same time. Heating the heat receiving surface with more than one flame at the same time allows using smaller flames to convey a specific amount of heat to the heat receiving surface as compared to using only one flame. Further, using more than one flame at the same time allows spatially distributing the heat in an efficient manner.

The aerosol-generating article may extend along an axial direction when the aerosol-generating article is at least partially received in the aerosol-generating device. The axial direction may correspond to a direction along which the aerosol-generating article is inserted into the aerosol-generating device.

At least two of the flames may be generated at different circumferential positions around the axial direction. Heat may thus be supplied from different circumferential angles around the axial direction.

At least two of the flames may be spaced along a direction parallel to the axial direction. Heat may thus be supplied at different positions along the axial direction.

According to another aspect of the present invention, there is provided a method for generating aerosol. The method comprises heating a heat receiving surface of an aerosol-generating device. The aerosol-generating device at least partially receives an aerosol-generating article extending along an axial direction. The heat receiving surface is heated with more than one flame at the same time.

At least two of the flames may be generated at different circumferential positions around the axial direction.

At least two of the flames may be spaced along a direction parallel to the axial direction.

According to a further aspect of the present invention, there is provided a use of an axially extending tube that circumferentially surrounds an aerosol-generating substance to achieve substantially homogeneous heating of the aerosol-generating substance, wherein a thermal resistance for heat transport through the tube along a radial direction varies along at least one of the axial direction and a circumference of the tube.

For example, the thermal resistance for heat transport through the tube along a radial direction may vary along at least one of the axial direction and a circumference of the tube by at least 200 percent, or by at least 150 percent, or by at least 100 percent, or by at least 70 percent, or by at least 50 percent, or by at least 30 percent, or by at least 20 percent, or by at least 10 percent of a minimum value of the thermal resistance for heat transport through the tube along a radial direction.

The thermal resistance for heat transport through the tube along a radial direction may change along at least one of the axial direction and the circumference of the tube in a way that influences heat transport towards the aerosol-generating substance to be substantially homogeneous. For example, a thermal resistance for heat transport through the tube along a radial direction may be highest at a location that is nearest to a heat source. The thermal resistance may decrease from that location along at least one of the axial direction and the circumference of the tube.

Substantially homogenous heating of the aerosol-generating substance may be achieved if during heating, a temperature difference of two portions of the aerosol-generating substance is not higher than 100 degrees Celsius, or not higher than 75 degrees Celsius, or not higher than 50 degrees Celsius, or not higher than 25 degrees Celsius, or not higher than 10 degrees Celsius. The aerosol-generating article referred to herein may be at least essentially rod-shaped.

The aerosol-generating article may extend in parallel to the axial direction, when at least partially inserted into the aerosol-generating device.

The aerosol-generating article may comprise an aerosol-generating section. The aerosol-generating section may comprise aerosol-generating material. The aerosol-generating material may be configured to release aerosol upon being heated. The aerosol-generating material may, for example, comprise herbaceous material. The aerosol-generating material may, for example, comprise tobacco material.

The aerosol-generating article may comprise a filter section. When the aerosol-generating article is inserted into the aerosol-generating device, the filter section may at least partially protrude from the aerosol-generating device to be accessible to a user.

According to a further aspect of the present invention there is provided an aerosol-generating system comprising an aerosol-generating device according to any one of the embodiments, aspects, or examples described herein. The aerosol-generating system also comprises the aerosol-generating article. The aerosol-generating article may comprise an aerosol-forming substrate which may be the aerosol-generating material. As used herein, the term "aerosol-generating article" refers to an article comprising an aerosol-forming substrate that, when heated, releases volatile compounds that can form an aerosol.

The aerosol-forming substrate may comprise a plug of tobacco. The tobacco plug may comprise one or more of: powder, granules, pellets, shreds, spaghettis, strips or sheets containing one or more of: tobacco leaf, fragments of tobacco ribs, reconstituted tobacco, homogenised tobacco, extruded tobacco and expanded tobacco. Optionally, the tobacco plug may contain additional tobacco or non-tobacco volatile flavour compounds, to be released upon heating of the tobacco plug. Optionally, the tobacco plug may also contain capsules that, for example, include the additional tobacco or non-tobacco volatile flavour compounds. Such capsules may melt during heating of the tobacco plug. Alternatively, or in addition, such capsules may be crushed prior to, during, or after heating of the tobacco plug.

Where the tobacco plug comprises homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The aerosol-generating article may have a total length of between approximately 30 millimetres and approximately 100 millimetres. The aerosol-generating article may have an external diameter of between approximately 5 millimetres and approximately 13 millimetres.

The aerosol-generating article may comprise a mouthpiece positioned downstream of the tobacco plug. The mouthpiece may be located at a downstream end of the aerosol-generating article. The mouthpiece may be a cellulose acetate filter plug. Preferably, the mouthpiece is approximately 7 millimetres in length, but can have a length of between approximately 5 millimetres to approximately 10 millimetres.

The tobacco plug may have a length of approximately 10 millimetres. The tobacco plug may have a length of approximately 12 millimetres.

The diameter of the tobacco plug may be between approximately 5 millimetres and approximately 12 millimetres.

In a preferred embodiment, the aerosol-generating article has a total length of between approximately 40 millimetres and approximately 50 millimetres. Preferably, the aerosol-generating article has a total length of approximately 45 millimetres. Preferably, the aerosol-generating article has an external diameter of approximately 7.2 millimetres.

The present disclosure comprise various aspects, embodiments, and examples. Features, advantages, and explanations disclosed with reference to any one of those aspects, embodiments, and examples may be combined with, or transferred to, any one of the remaining aspects, embodiments, and examples. The aerosol-generating devices or systems described herein may be suitable, adapted and configured to carry out the methods for generating aerosol described herein.

Where the present disclosure refers to a material of an item having a certain specific heat capacity and the item is comprised of different individual materials (for example different material layers), the specific heat capacity of the material of the item is to be understood as corresponding to a weighted average of the specific heat capacities of the individual materials of which the item is comprised. The weighting is understood to be carried out according to the mass percentages of the individual materials of which the item is comprised.

Where the present disclosure refers to a material of an item having a certain thermal conductivity and the item is comprised of different individual materials (for example different material layers), the thermal conductivity of the material of the item is to be understood as corresponding to a weighted average of the thermal conductivities of the individual materials of which the item is comprised. The weighting is understood to be carried out according to the mass percentages of the individual materials of which the item is comprised.

The expression "rod-shaped" as used herein includes, but is not limited to, rod-shapes with a circular cross-section. "Rod-shaped" as used herein may also include rod-shapes with other cross-sections, such as, for example, a rectangular cross-section, or an elliptic cross-section, or a triangular cross-section, or an irregular cross-section, or any other cross-section. The expression "rod-shaped" may include cylindrical shapes, whereby the base surface of the cylinder may be a circular surface or a surface of any other shape, such as a rectangular surface, or an elliptic surface, or a triangular surface, or an irregular surface, or any other surface.

When a first item immerses into a second item, the first item may at least partially enter a volume of the second item. After immersing into the second item, at least a part of the first item may be surrounded by the second item. For example, a first item may immerse into a second item by being pushed into the second item.

The invention is defined in the claims. However, below there is provided a non-exhaustive list of non-limiting examples. Any one or more of the features of these examples may be combined with any one or more features of another example, embodiment, or aspect described herein.

Example Ex1: Aerosol-generating device comprising:

- an axially extending heating space configured to at least partially receive an aerosol-generating article;
- a heat receiving surface provided outside of the heating space;
- a heat storage body provided between the heat receiving surface and the heating space; and
- an inner heat conduction body provided between the heat storage body and the heating space;

wherein a material of the heat storage body has a higher specific heat capacity than a material of the inner heat conduction body; and wherein the material of the inner heat conduction body has a higher thermal conductivity than the material of the heat storage body.

Example Ex2: Aerosol-generating device according to Example Ex1, wherein the material of the heat storage body has a specific heat capacity between 300 joule per kelvin per kilogram and 1500 joule per kelvin per kilogram, or between 500 joule per kelvin per kilogram and 1200 joule per kelvin per kilogram, or between 600 joule per kelvin per kilogram and 1000 joule per kelvin per kilogram, or between 600 joule per kelvin per kilogram and 800 joule per kelvin per kilogram.

Example Ex3: Aerosol-generating device according to Example Ex1 or Ex2, wherein one or both of the material of the heat storage body and the material of the inner heat conduction body has a melting temperature above 800 degrees Celsius, or above 900 degrees Celsius, or above 1000 degrees Celsius, or above 1100 degrees Celsius, or above 1300 degrees Celsius, or above 1500 degrees Celsius.

Example Ex4: Aerosol-generating device according to any one of Examples Ex1 to Ex3, wherein one or both of the heat storage body and the inner heat conduction body circumferentially surround the heating space.

Example Ex5: Aerosol-generating device according to any one of Examples Ex1 to Ex4, wherein the inner heat conduction body comprises a protrusion extending into the heating space and configured to immerse into the aerosol-generating article upon insertion of the aerosol-generating article into the heating space.

Example Ex6: Aerosol-generating device according to any one of Examples Ex1 to Ex5, wherein the inner heat conduction body forms at least a part of a wall defining the heating space.

Example Ex7: Aerosol-generating device according to any one of Examples Ex1 to Ex6, wherein the inner heat conduction body is in contact with the heat storage body.

Example Ex8: Aerosol-generating device according to any one of Examples Ex1 to Ex7, further comprising an outer heat conduction body provided between the heat receiving surface and the heat storage body.

Example Ex9: Aerosol-generating device according to Example Ex8, wherein a material of the outer heat conduction body has a higher thermal conductivity than the material of the heat storage body.

Example Ex10: Aerosol-generating device according to Example Ex8 or Ex9, wherein the material of the heat storage body has a higher specific heat capacity than the material of the outer heat conduction body.

Example Ex11: Aerosol-generating device according to any one of Examples Ex8 to Ex10, wherein a thermal resistance for heat transport through the outer heat conduction body in a radial direction is different at at least two different locations of the outer heat conduction body.

Example Ex12: Aerosol-generating device according to any one of Examples Ex8 to Ex11, wherein a thickness of the outer heat conduction body is different at at least two different locations of the outer heat conduction body.

Example Ex13: Aerosol-generating device according to any one of Examples Ex8 to Ex12, wherein one or more channels are provided in the outer heat conduction body.

Example Ex14: Aerosol-generating device according to any one of Examples Ex8 to Ex13, wherein a thermal resistance for heat transport through the outer heat conduction body along a radial direction is highest at the heat receiving surface.

Example Ex15: Aerosol-generating device according to any one of Examples Ex8 to Ex14, wherein the outer heat conduction body comprises at least two different materials having different thermal conductivities.

Example Ex16: Aerosol-generating device according to any one of Examples Ex1 to Ex15, further comprising a heater configured to generate one or more flames to heat the heat receiving surface.

Example Ex17: Aerosol-generating system, comprising:

the aerosol-generating device according to any one of the preceding claims; and the aerosol-generating article;

wherein the aerosol-generating article has an aerosol-generating section comprising material configured to generate aerosol upon being heated;

wherein the aerosol-generating section is at least partially received in the heating space when the aerosol-generating article is at least partially received in the heating space.

Example Ex18: Aerosol-generating system according to Example Ex17, wherein the aerosol-generating article comprises a mouthpiece configured to protrude from the aerosol-generating device when the aerosol-generating article is at least partially received in the heating Example Ex19: Aerosol-generating system according to Example Ex17 or Ex18, further comprising a heater configured to heat the heat receiving surface.

Example Ex20: Method for generating aerosol, comprising:

heating a heat receiving surface of an aerosol-generating device;

wherein the aerosol-generating device at least partially receives an aerosol-generating article; and storing heat from heating the heat receiving surface in a heat storage body provided between the heat receiving surface and the aerosol-generating article; and distributing heat to the aerosol-generating article via an inner heat conduction body provided between the heat storage body and the aerosol-generating article, wherein a material of the heat storage body has a higher specific heat capacity than a material of the inner heat conduction body.

Example Ex21: Method according to Example Ex20, wherein the heat receiving surface is heated with more than one flame at the same time.

Example Ex22: Method according to Example Ex21, wherein the aerosol-generating article extends along an axial direction when the aerosol-generating article is at least partially received in the aerosol-generating device, and wherein at least two of the flames are generated at different circumferential positions around the axial direction.

Example Ex23: Method according to Example Ex21, wherein the aerosol-generating article extends along an axial direction when the aerosol-generating article is at least partially received in the aerosol-generating device, and wherein at least two of the flames are spaced along a direction parallel to the axial direction.

Example Ex24: Method for generating aerosol, comprising:

heating a heat receiving surface of an aerosol-generating device;

wherein the aerosol-generating device at least partially receives an aerosol-generating article extending along an axial direction; and wherein the heat receiving surface is heated with more than one flame at the same time.

Example Ex25: Method according to Example Ex24, wherein at least two of the flames are generated at different circumferential positions around the axial direction.

Example Ex26: Method according to Example Ex24 or Ex25, wherein at least two of the flames are spaced along a direction parallel to the axial direction.

Example Ex27: Method according to any one of Examples Ex20 to Ex26, wherein the aerosol-generating device is the aerosol-generating device of any one of Examples Ex1 to Ex16 or of the aerosol-generating system of any one of Examples Ex17 to Ex19.

Example Ex28: Use of an axially extending tube that circumferentially surrounds an aerosol-generating substance to achieve substantially homogeneous heating of the aerosol-generating substance, wherein a thermal resistance for heat transport through the tube along a radial direction varies along at least one of the axial direction and a circumference of the tube.

Embodiments will now be further described with reference to the figures, in which.

Figure 1:
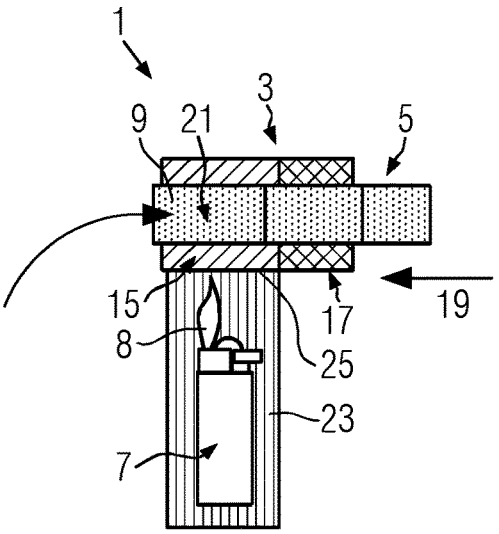
FIG. 1 shows an aerosol-generating system according to an embodiment in which a heat receiving surface is provided radially outside of an axially extending heating space.

FIG. 1 shows an aerosol-generating system 1 according to an embodiment. The aerosol-generating system 1 comprises an aerosol-generating device 3, an aerosol-generating article 5, and a heater 7.

Figure 3:
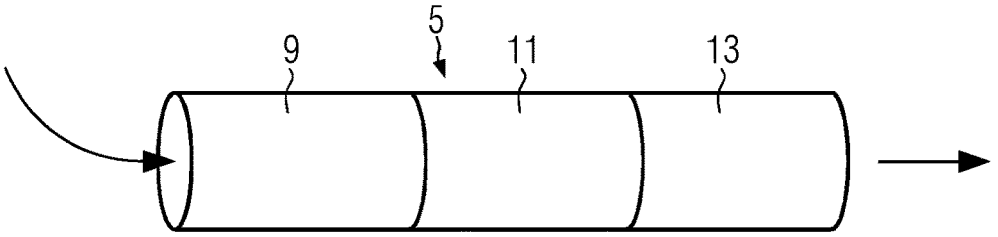
FIG. 3 shows an aerosol-generating article of an aerosol-generating system according to an embodiment.

FIG. 3 shows an exemplary embodiment of an aerosol-generating article 5 that may be used with the aerosol-generating device 3. The aerosol-generating article 5 comprises sections that are arranged one behind the other along an axial direction. The sections are connected to each other by one or more wrappers that may span one or more of the sections. The sections comprise an aerosol-generating section 9, a spacer section 11, and a filter section 13. The aerosol-generating section 9 comprises aerosol-generating material that is configured to generate aerosol-generating upon being heated. The aerosol-generating material may comprise herbaceous material, in particular tobacco material. The filter section 13 may comprise a filter through which aerosol passes before reaching the mouth of a user. The spacer section 11 may be arranged between the aerosol-generating section 9 and the filter section 13. Aerosol generated in the aerosol-generating section 9 may cool down while passing through the spacer section 11 to reduce a temperature of the aerosol before consumption.

As shown in FIG. 1, the aerosol-generating device 3 comprises an axially extending heating chamber 15 and a storage chamber 17 provided in coaxial arrangement with the heating chamber 15. The aerosol-generating article 5 may be inserted into the aerosol-generating device 3 in an insertion direction 19. In FIG. 1, the aerosol-generating article 5 is received in the aerosol-generating device 3 in a consumption position. In the consumption position, the aerosol-generating section 9 is received in a heating space 21 defined by the heating chamber 15.

In the embodiment of FIG. 1, the heater 7 is a conventional cigarette lighter. The aerosol-generating device 3 may comprise a heater receiving section 23 configured to receive the heater 7. Alternatively, the heater 7 may be an integral part of the aerosol-generating device 3, or the heater 7 may not be combined with or received in the aerosol-generating device 3, but may be a separate heater 7. Preferably, the heater 7 is configured to generate one or more flames 8.

The heater 7 is configured to heat a heat receiving surface 25 of the heating chamber 15. By heating the heat receiving surface 25, the heating space 21 within the heating chamber 15 is heated, thereby heating the aerosol-generating section 9 of the aerosol-generating article 3. When heated, the aerosol-generating section 9 generates aerosol. When a user draws air through the filter section 13, an airflow through the aerosol-generating article 5 (see arrows in FIG. 1) may be created. The airflow may carry the aerosol generated in the heating space 21 towards the user.

In the embodiment of FIG. 1, the heat receiving surface 25 is provided radially outside of the heating space 21. A direction along which the heater 7 emits a flame 8 to heat the heat receiving surface 25 is essentially oriented in a direction perpendicular to the axial direction (direction of extension of the heating chamber 15 and the storage chamber 17).

Figure 2:
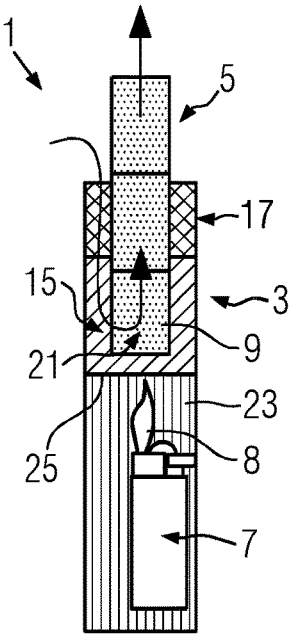
FIG. 2 shows an aerosol-generating system according to an embodiment in which a heat receiving surface is provided axially aligned with an axially extending heating space.

FIG. 2 shows an alternative embodiment, according to which the heat receiving surface 25 is arranged axially in line with the heating space 21. The heater 7 emits a flame 8 in a direction essentially along the axial direction.

Figure 4:
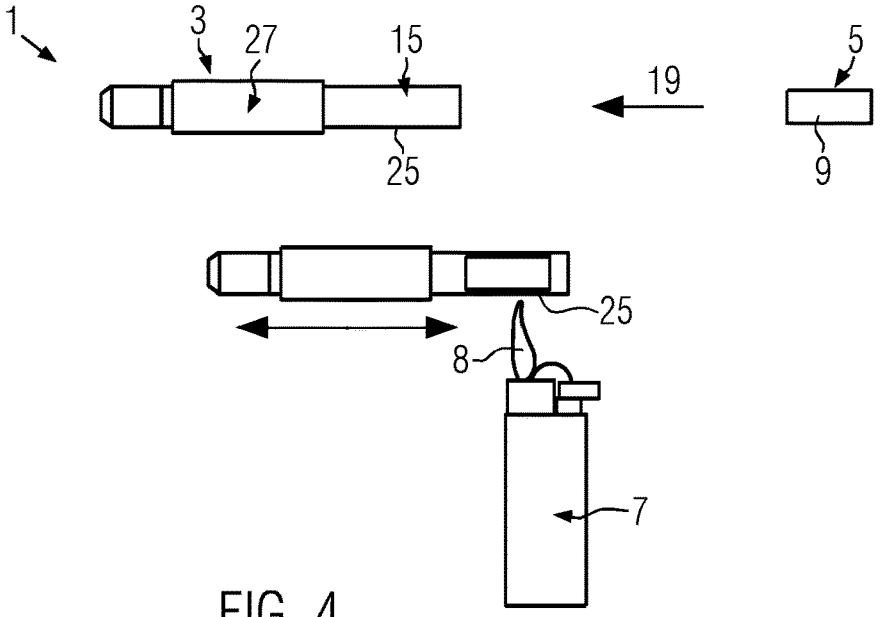
FIG. 4 shows an aerosol-generating system according to an embodiment using a conventional cigarette lighter.

FIG. 4 illustrates another embodiment of an aerosol-generating system 1. The respective aerosol-generating device 3 comprises a tube extending along the axial direction and defining a heating chamber 15 having a heating space 21 therein. An aerosol-generating article 5 may be inserted into the heating space 21 along an insertion direction 19 that is parallel to the axial direction. In the illustrated embodiment, the aerosol-generating article 5 essentially only comprises the aerosol-generating section 9. However, the aerosol-generating article 5 could also comprise additional sections, such as the spacer section 11 and the filter section 13. The aerosol-generating device 3 comprises a heat protection sleeve 27 that allows a user to hold the aerosol-generating device 3 without risking injury or inconvenience due to a high temperature of the aerosol-generating device 3. As indicated by the double arrow in the lower part of FIG. 4, the heat protection sleeve 27 may be slid with respect to the tube defining the heating chamber 15. A heater 7, such as a conventional cigarette heater, may be used to heat a heat receiving surface 25. The heat receiving surface 25 according to the embodiment of FIG. 4 is provided radially outside of the heating space 21 receiving the aerosol-generating section 9. In FIG. 4, the heater 7 is not inserted into or attached to the aerosol-generating device 3.

Figure 5:
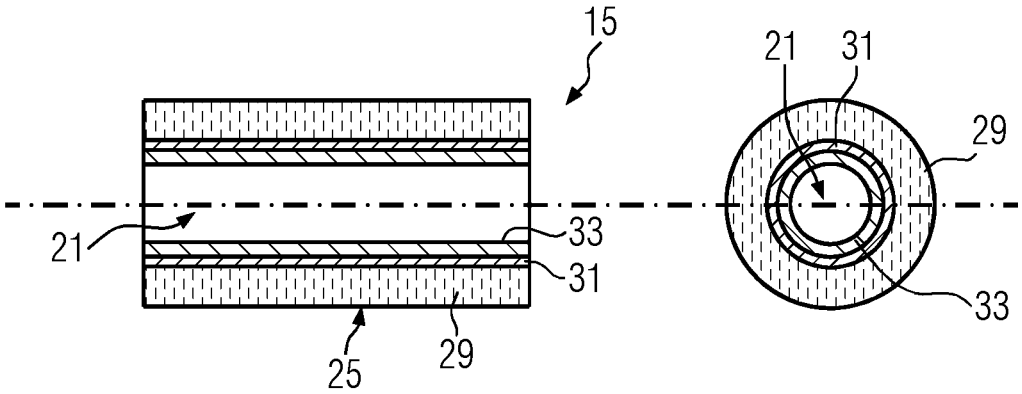
FIG. 5 shows schematic sectional views through a heating chamber according to an embodiment.
Figure 6:
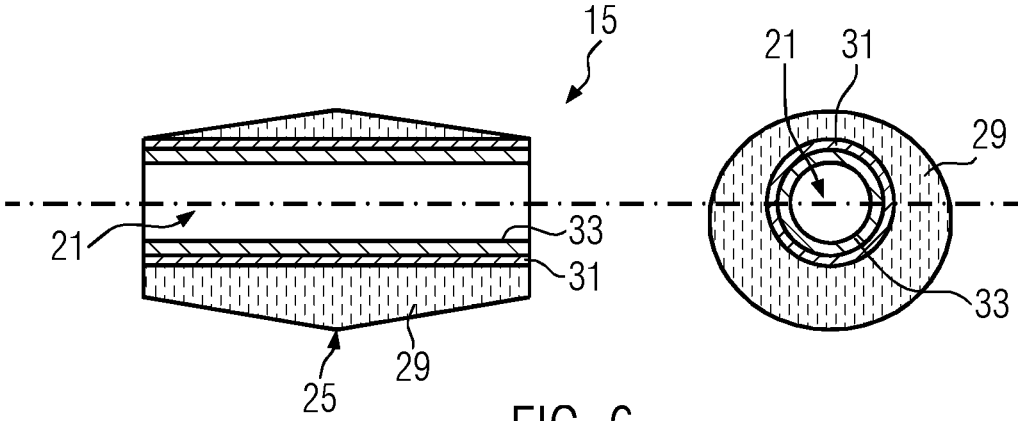
FIG. 6 shows schematic sectional views through a heating chamber according to another embodiment.
Figure 7:
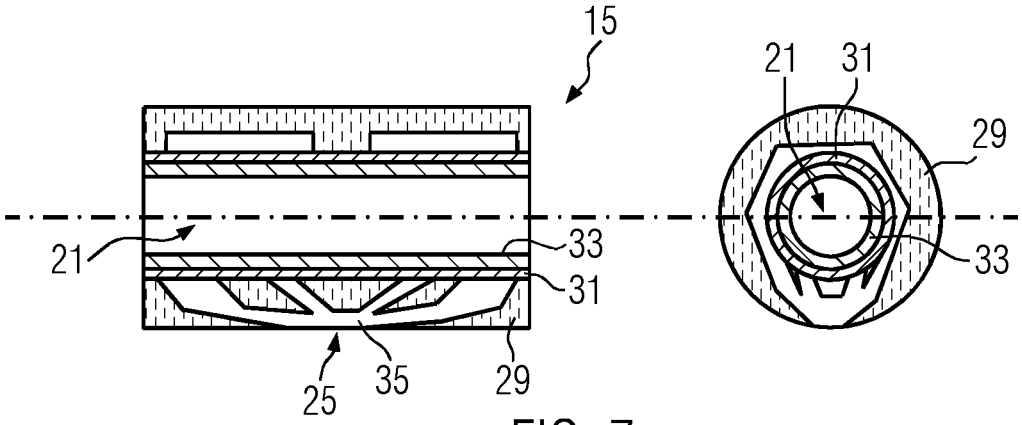
FIG. 7 shows schematic sectional views through a heating chamber according to a further embodiment.

FIGS. 5, 6, and 7 show cross-sectional views through different embodiments of the heating chamber 15. The left parts of FIGS. 5, 6 and 7 show sectional views through the heating chamber 15 with the sectional plane being parallel to the axial direction. The right parts of FIGS. 5, 6 and 7 show sectional views through the respective heating chamber 15 with the sectional plane being perpendicular to the axial direction. The heating chambers of FIGS. 5, 6 and 7 may, for example, be part of the aerosol-generating devices 3 of FIGS. 1 and 4.

In FIGS. 5, 6 and 7, the heating chamber 15 comprises multiple layers circumferentially surrounding the heating space 21. An outer heat conduction body 29 forms an outer layer of the heating chamber 15. The heat receiving surface 25 is a part of a radially outer surface of the outer heat conduction body 29. Radially inside of the outer heat conduction body 29, there is heat storage body 31 forming a layer circumferentially surrounding the heating space 21. Radially inside of the heat storage body 31, there is an inner heat conduction body 33 circumferentially surrounding the heating space 21.

A material of the heat storage body 31 has a higher specific heat capacity than a material of the inner heat conduction body 33 and a material of the outer heat conduction body 29. The material of the outer heat conduction body 29 and the material of the inner heat conduction body 33 have higher thermal conductivities than the material of the heat storage body 31. The material of the heat storage body 31 may, for example, be glass or metal. One or both of the material of the inner heat conduction body 33 and the material of the outer heat conduction body 29 may be a metal, such as copper, brass or aluminum, for example.

When the heat receiving surface 25 is heated, the heat is efficiently guided radially inside towards the heat storage body 31 by the outer heat conduction body 29. The heat storage body 31, due to its high specific heat capacity, may serve as a buffer taking up comparatively large amounts of heat and giving the heat up over time to heat the heating space 21 and the aerosol-generating section 9 provided therein. The inner heat conduction body 33 forms an inner surface of the heating chamber 15 defining the heating space 21. The inner heat conduction body 33 efficiently conducts heat from the heat storage body 31 towards the heating space 21 and the aerosol-generating section 9 provided therein.

In FIG. 5, the outer heat conduction body 29, the heat storage body 31, and the inner heat conduction body 33 are symmetrical with respect to the axial direction. The outer heat conduction body 29, the heat storage body 31, and the inner heat conduction body 33 form concentric sleeves circumferentially surrounding the heating space 21.

In FIG. 6, the heat storage body 31 and the inner heat conduction body 33 correspond to the heat storage body 31 and the inner heat conduction body 33 of FIG. 5. The outer heat conduction body 29, however, is not symmetrical with respect to the axial direction. A thickness of the outer heat conduction body 29 varies along both the circumferential direction and the axial direction. The thickness of the outer heat conduction body 29 is highest at the heat receiving surface 25. In particular, the thickness of the outer heat conduction body 29 is highest at the center of the heat receiving surface 25. With increasing distance from the center of the heat receiving surface 25, both along the axial direction and along the circumferential direction, the thickness of the outer heat conduction body 29 decreases.

Due to the different thickness of the outer heat conduction body 29 at different locations, a thermal resistance for heat transport through the outer heat conduction body 29, and thus through the walls of the heating chamber 15, along a radial direction is different for different locations. Due to the highest thickness of the outer heat conduction body 29 at the heat receiving surface 25, in particular at the center of the heat receiving surface 25, the thermal resistance for heat transport through the outer heat conduction layer 29 along the radial direction is highest at the heat receiving surface 25. This may counteract an inhomogeneous temperature distribution within the heating space 21 by having a reduced thermal resistance for heat transport at locations that are farther away from the heat receiving surface 25 and would therefore normally receive less heat.

In FIG. 7, the heat storage body 31 and the inner heat conduction body 33 correspond to the heat storage body 31 and the inner heat conduction body 33 of FIGS. 5 and 6. The outer heat conduction body 29 comprises channels 35 formed in the outer heat conduction body 29. The channels 35 may form flow paths for heated air. A flow cross-section of the channels 35 may vary along at least one of the axial direction and the circumferential direction. A flow cross-section of the channels 35 may be larger in regions farther away from a center of the heat receiving surface 25 to facilitate flow of hot air to those regions.

Figure 8:
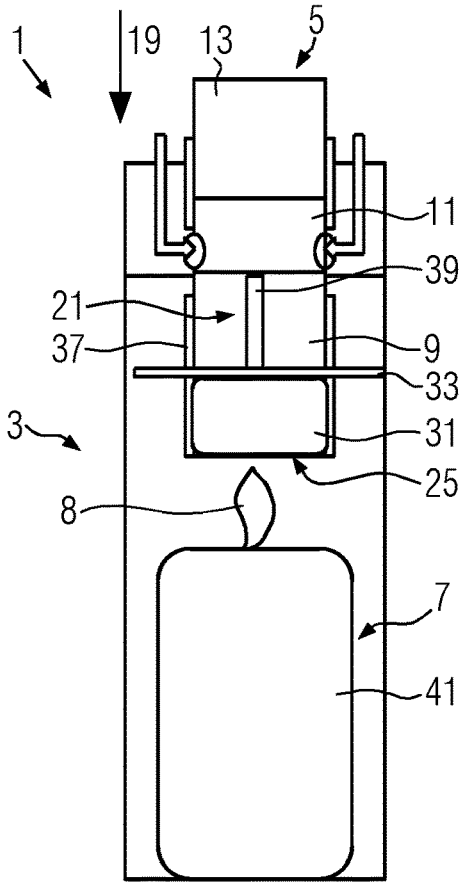
FIG. 8 shows a schematic sectional view of an aerosol-generating system according to an embodiment having a heat receiving surface axially aligned with an axially extending heating space.

FIG. 8 shows a cross-sectional view of an aerosol-generating system 1 in which the heat receiving surface 25 is axially aligned with the heating space 21, substantially in line with the embodiment of FIG. 2. In the embodiment of FIG. 8, the heat storage body 31 is axially aligned with the heating space 21. The heat storage body 31 is provided downstream of the heating space 21 with respect to the insertion direction 19. An outer surface of the heat storage body 31 forms the heat receiving surface 25. In the embodiment of FIG. 8, no outer heat conduction body 29 is provided. However, as an alternative, an outer heat conduction body 29 could be provided downstream of the heat storage body 25 with respect to the insertion direction 19.

Between the heat storage body 31 and the heating space 21, an inner heat conduction body 33 is provided. The inner heat conduction body 33 comprises a plate extending essentially perpendicular to the axial direction between the heat storage body 31 and the heating space 21. Further, the inner heat conduction body 33 comprises a cylindrical sleeve part 37 circumferentially surrounding the heating space 21. Further, the inner heat conduction body 33 comprises a protrusion 39 extending into the heating space 21. The protrusion 39 is configured to immerse into the aerosol-generating section 9 of the aerosol-generating article 5.

In the embodiment of FIG. 8, the heater 7 is integrated into the aerosol-generating device 3. The heater 7 comprises a gas tank 41 supplying gas for a flame 8 heating the heat receiving surface 25.

Figure 9:
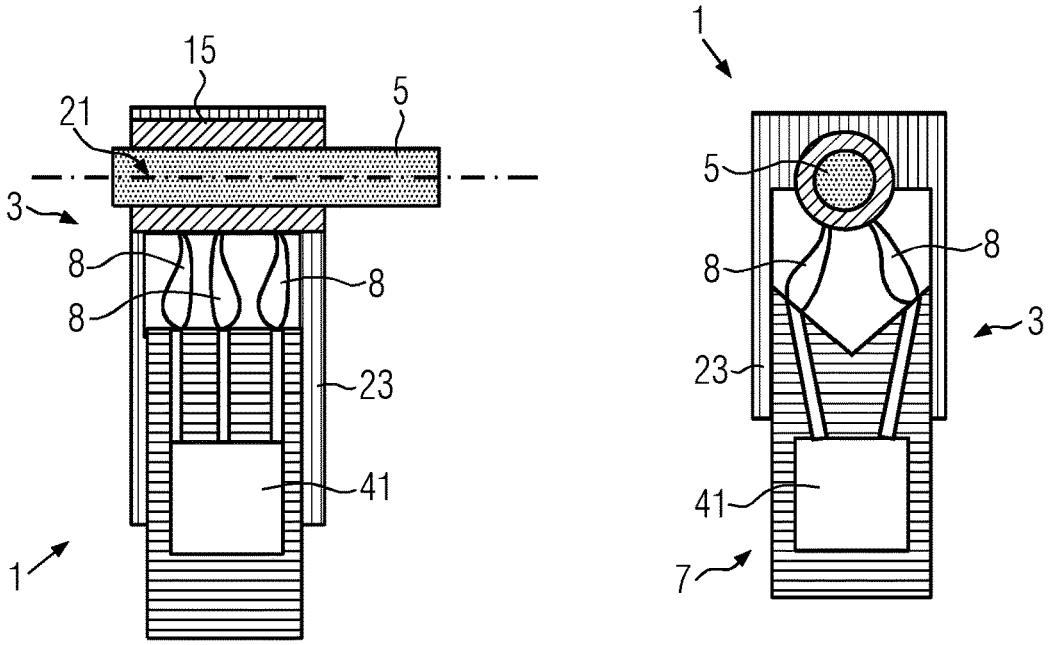
FIG. 9 shows an embodiment of an aerosol-generating system having a heater generating multiple flames.

FIG. 9 shows another embodiment of an aerosol-generating system 1. The left part of FIG. 9 shows a sectional view of the system 1 with the sectional plane being parallel to the axial direction. The right part of FIG. 9 shows a sectional view of the system 1 with the sectional plane being perpendicular to the axial direction.

The heater 7 of the system 1 of FIG. 9 is configured to generate a plurality of flames 8 for heating the heat receiving surface 25. As shown in the left part of FIG. 9, some of the flames 8 are spaced along the axial direction to provide improved heat distribution along the axial direction. As shown in the right part of FIG. 9, some of the flames 8 are generated at locations that are spaced along the circumferential direction to distribute heating along the circumferential direction. The heater 7 may be an integral part of the aerosol-generating device 3. The heater 7 may be combined with the aerosol-generating device 3. The heater 7 may be received in a heater receiving section 23 of the aerosol-generating device 3.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±5 percent of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating device comprising:

an axially extending heating space configured to at least partially receive an aerosol-generating article;

a heat receiving surface provided outside of the heating space;

a heat storage body provided between the heat receiving surface and the heating space; and an inner heat conduction body provided between the heat storage body and the heating space;

wherein a material of the heat storage body has a higher specific heat capacity than a material of the inner heat conduction body; and wherein the material of the inner heat conduction body has a higher thermal conductivity than the material of the heat storage body.

2. The aerosol-generating device according to claim 1, wherein the material of the heat storage body has a specific heat capacity between 300 joule per kelvin per kilogram and 1500 joule per kelvin per kilogram, or between 500 joule per kelvin per kilogram and 1200 joule per kelvin per kilogram, or between 600 joule per kelvin per kilogram and 1000 joule per kelvin per kilogram, or between 600 joule per kelvin per kilogram and 800 joule per kelvin per kilogram.

3. The aerosol-generating device according to claim 1, wherein the inner heat conduction body comprises a protrusion extending into the heating space and configured to immerse into the aerosol-generating article upon insertion of the aerosol-generating article into the heating space.

4. The aerosol-generating device according to claim 1, further comprising an outer heat conduction body provided between the heat receiving surface and the heat storage body.

5. The aerosol-generating device according to claim 4, wherein a thermal resistance for heat transport through the outer heat conduction body in a radial direction is different at least two different locations of the outer heat conduction body.

6. The aerosol-generating device according to claim 4, wherein a thickness of the outer heat conduction body is different at least two different locations of the outer heat conduction body.

7. The aerosol-generating device according to claim 4, wherein one or more channels are provided in the outer heat conduction body.

8. The aerosol-generating device according to claim 4, wherein a thermal resistance for heat transport through the outer heat conduction body along a radial direction is highest at the heat receiving surface.

9. The aerosol-generating device according to claim 4, wherein the outer heat conduction body comprises at least two different materials having different thermal conductivities.

10. The aerosol-generating device according to claim 1, further comprising a heater configured to generate one or more flames to heat the heat receiving surface.

11. An aerosol-generating system, comprising:

the aerosol-generating device according to claim 1; and the aerosol-generating article;

wherein the aerosol-generating article has an aerosol-generating section comprising material configured to generate aerosol upon being heated;

wherein the aerosol-generating section is at least partially received in the heating space when the aerosol-generating article is at least partially received in the heating space.

12. A method for generating aerosol, comprising:

heating a heat receiving surface of an aerosol-generating device;

wherein the aerosol-generating device at least partially receives an aerosol-generating article; and storing heat from heating the heat receiving surface in a heat storage body provided between the heat receiving surface and the aerosol-generating article; and distributing heat to the aerosol-generating article via an inner heat conduction body provided between the heat storage body and the aerosol-generating article, wherein a material of the heat storage body has a higher specific heat capacity than a material of the inner heat conduction body.

13. The method according to claim 12, wherein the heat receiving surface is heated with more than one flame at the same time.

14. The method according to claim 13, wherein the aerosol-generating article extends along an axial direction when the aerosol-generating article is at least partially received in the aerosol-generating device, and wherein at least two of the flames are at least one of spaced along a direction parallel to the axial direction and generated at different circumferential positions around the axial direction.

15. A method for heating an aerosol-generating substance, comprising heating an axially extending tube that circumferentially surrounds the aerosol-generating substance to achieve substantially homogeneous heating of the aerosol-generating substance, wherein a thermal resistance for heat transport through the tube along a radial direction varies along at least one of the axial direction and a circumference of the tube by at least 10 percent of a minimum value of the thermal resistance for heat transport through the tube along a radial direction.

* * * * *